US010370928B2

(12) United States Patent
Noakes et al.

(10) Patent No.: US 10,370,928 B2
(45) Date of Patent: Aug. 6, 2019

(54) STRUCTURE WITH FEED THROUGH

(71) Applicant: Schlumberger Technology Corporation, Sugar Land, TX (US)

(72) Inventors: David Noakes, Southampton (GB); Robert Graham, Southampton (GB); Colin Wilson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 374 days.

(21) Appl. No.: 14/893,810

(22) PCT Filed: May 30, 2014

(86) PCT No.: PCT/US2014/040136
§ 371 (c)(1),
(2) Date: Nov. 24, 2015

(87) PCT Pub. No.: WO2014/194158
PCT Pub. Date: Dec. 4, 2014

(65) Prior Publication Data

US 2016/0102520 A1 Apr. 14, 2016

Related U.S. Application Data

(60) Provisional application No. 61/829,018, filed on May 30, 2013.

(51) Int. Cl.
*E21B 29/04* (2006.01)
*E21B 33/068* (2006.01)
(Continued)

(52) U.S. Cl.
CPC ..... *E21B 33/068* (2013.01); *E21B 29/04* (2013.01); *E21B 33/063* (2013.01); *E21B 47/065* (2013.01)

(58) Field of Classification Search
CPC ..... E21B 33/068; E21B 47/065
See application file for complete search history.

(56) References Cited

U.S. PATENT DOCUMENTS 3,357,490 A * 12/1967 Holmes ..... E21B 63/001 137/80
3,582,038 A * 6/1971 Harbonn ..... E21B 34/04 251/71
(Continued)

OTHER PUBLICATIONS

Search Report and Written Opinion of International Application No. PCT/US2014/040136 dated Sep. 25, 2014, 9 pages.

*Primary Examiner* — Matthew R Buck
*Assistant Examiner* — Aaron L Lembo

(57) ABSTRACT

A technique provides protection against unwanted conditions in wellhead structures and other structures. According to the technique, a system provides a feed through in a wellhead structure or other type of structure. The feed through may accommodate a communication line routed therethrough. A closing device is positioned in the structure at a location to enable closing of the feed through via the closing device. Additionally, a condition-sensitive device is operatively engaged with the closing device to initiate actuation of the closing device once the condition-sensitive device is exposed to a predetermined condition. Upon exposure to the predetermined condition, the condition-sensitive device initiates closing of the feed through via the closing device.

20 Claims, 4 Drawing Sheets

(51) Int. Cl.
*E21B 33/06* (2006.01)
*E21B 47/06* (2012.01)

(56) References Cited

U.S. PATENT DOCUMENTS 3,747,618 A * 7/1973 Boes ..... E21B 29/04 137/486
4,527,631 A * 7/1985 Vazquez ..... E21B 23/03 166/117.5
4,553,589 A * 11/1985 Jennings ..... E21B 34/16 137/72
4,653,776 A * 3/1987 Borg ..... F16L 55/00 166/363
4,658,904 A * 4/1987 Doremus ..... E21B 34/045 137/614.19
5,109,881 A * 5/1992 Baker ..... E21B 34/16 137/72
5,771,974 A * 6/1998 Stewart ..... E21B 34/045 166/322
6,000,311 A * 12/1999 Katoh ..... G21C 9/00 83/580
6,450,477 B1 9/2002 Young
7,301,472 B2 11/2007 Kyle et al.
7,380,609 B2 6/2008 Page et al.
7,906,727 B2 * 3/2011 Bradley ..... E21B 33/038 114/322
8,171,989 B2 * 5/2012 Goode ..... B63G 8/001 166/250.01
8,607,872 B1 * 12/2013 Bugariu ..... E21B 35/00 166/316
8,708,054 B2 * 4/2014 Dailey, Jr. ..... E21B 34/045 166/250.01
2011/0308619 A1 * 12/2011 Martino ..... E21B 34/02 137/1
2012/0067567 A1 3/2012 Rytlewski et al.
2012/0227983 A1 9/2012 Lymberopoulos et al.
2012/0260991 A1 * 10/2012 Inglis ..... F16K 5/0605 137/1

* cited by examiner

STRUCTURE WITH FEED THROUGH

CROSS-REFERENCE TO RELATED APPLICATION

The present document is based on and claims priority to U.S. Provisional Application Ser. No. 61/829,018, filed May 30, 2013, incorporated herein by reference.

BACKGROUND

Well control and well integrity involve the placement of barriers for reducing or eliminating passage of fluid, gases, vapors and/or condensate beyond a defined boundary. Wellhead outlets are barriers that allow for cables, fibers, cap tubing, conductors and other communication lines to enter a well, thus allowing for communication to downhole sensors and equipment. These downhole devices receive electrical, hydraulic or optical signals along communication lines to power, cycle, interrogate or actuate the device. A feed through may be used to provide a path for the communication lines extending between the downhole devices and surface equipment or subsea equipment. In many applications, the wellhead outlets are designed to satisfy safety standards dictated by governing bodies that specify wellhead outlet standards. These standards address various conditions related to pressure, temperature, explosive potential, and other conditions. Examples of such standards include fire rating standards defined in ATEX, IECEx, NEC and AEx.

SUMMARY

In general, a system and methodology are provided to meet certain industry standards and to thus protect against unwanted condition migration in wellhead structures or other types of structures. The system and methodology comprise providing a feed through in a structure, such as a wellhead structure. Once installed, a communication line may be routed through the feed through. A closing device is positioned in the structure at a location to enable closing of the feed through via the closing device. Additionally, a condition-sensitive device, e.g. a temperature-sensitive device, is operatively engaged with the closing device to initiate actuation of the closing device once the condition-sensitive device is exposed to a predetermined condition, e.g. a high temperature caused by a fire. Upon exposure to the predetermined condition, the condition-sensitive device initiates closing of the feed through via the closing device.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
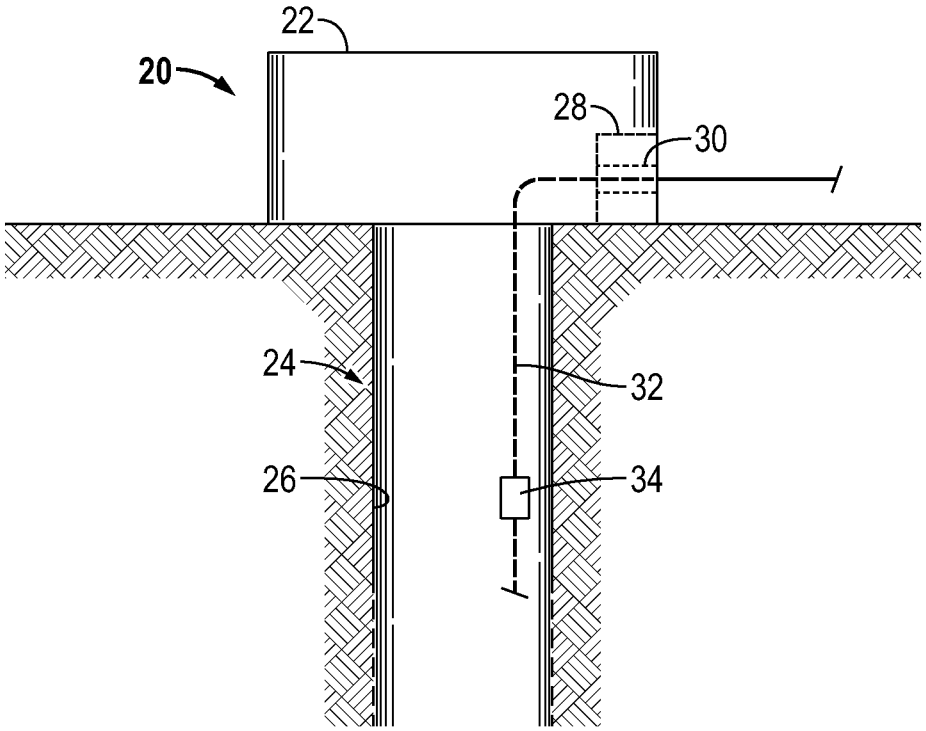
FIG. 1 is a schematic illustration of an example of a well system having a wellhead structure with a closing device, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for protecting against certain undesirable conditions. In well applications, for example, the technique enables protection of the integrity of a well system against fire as set forth in certain industry standards. The system and methodology comprise providing a feed through in a structure, such as a wellhead structure. Once installed, a communication line may be routed through the feed through. Additionally, a closing device is positioned in the structure at a location to enable closing of the feed through under a predetermined condition, e.g. a high temperature condition. A condition-sensitive device also is operatively engaged with the closing device to initiate actuation of the closing device once the condition-sensitive device is exposed to the predetermined condition, e.g. a high temperature caused by a fire. Upon exposure to the predetermined condition, the condition-sensitive device initiates closing of the feed through via the closing device.

In certain well related embodiments, the technique described herein enables passage of a communication line, e.g. a fiber, an electrical conductor, or a hydraulic path, through a wellhead for use under normal operating conditions. The communication line can be sheared by rotation, translation, or some combination thereof within a feed through of a wellhead structure. For example, a closing device may be used to shear the communication line and to close the feed through. In some applications, the closing device may be powered by a spring once a predetermined temperature condition (or other predetermined condition) is reached. The spring may be in compression or tension, and it can be vertically or horizontally positioned within the assembly. A shear member, e.g. a shear pin, may be positioned in the wellhead structure to prevent actuation of the closing device by the spring during normal operations, thus preventing premature shearing of the communication line.

Once the predetermined condition is met, the shear member breaks and the spring causes movement of the closing device. For example, the spring may cause rotation or translation of the closing device to shear the communication line and to seal the feed through path. The closing device may have a variety of structures and forms able to rotate or translate to a position closing the leak path along the feed through. In the case of a rotational design in which the closing device is rotated, a conical section may be used to ensure positive contact with a metal-to-metal sealing face throughout the rotational movement, as described in greater detail below.

Referring generally to FIG. 1, an embodiment of a well system 20 is illustrated. In this embodiment, well system 20 comprises a wellhead 22 positioned above a well 24 having at least one wellbore 26, e.g. a vertical and/or deviated wellbore. The wellhead 22 comprises a structure 28 having a feed through 30. Although the feed through 30 is illustrated as horizontal, the actual orientation may be horizontal, vertical, or at other desired orientations depending on the design of the overall well system 20. It should be noted that structure 28 is illustrated as a wellhead structure, but the structure 28 may be employed in other types of systems, including non-well related systems.

A communication line 32 may be routed through feed through 30 of wellhead structure 28. In the example illustrated, the communication line 32 extends through feed through 30 and down into wellbore 26 for coupling with a suitable downhole device or devices 34. By way of example, the communication line 32 may comprise an optical fiber communication line, an electrical conductor communication line, a hydraulic communication line, or other suitable communication lines or combinations of communication lines.

Figure 2:
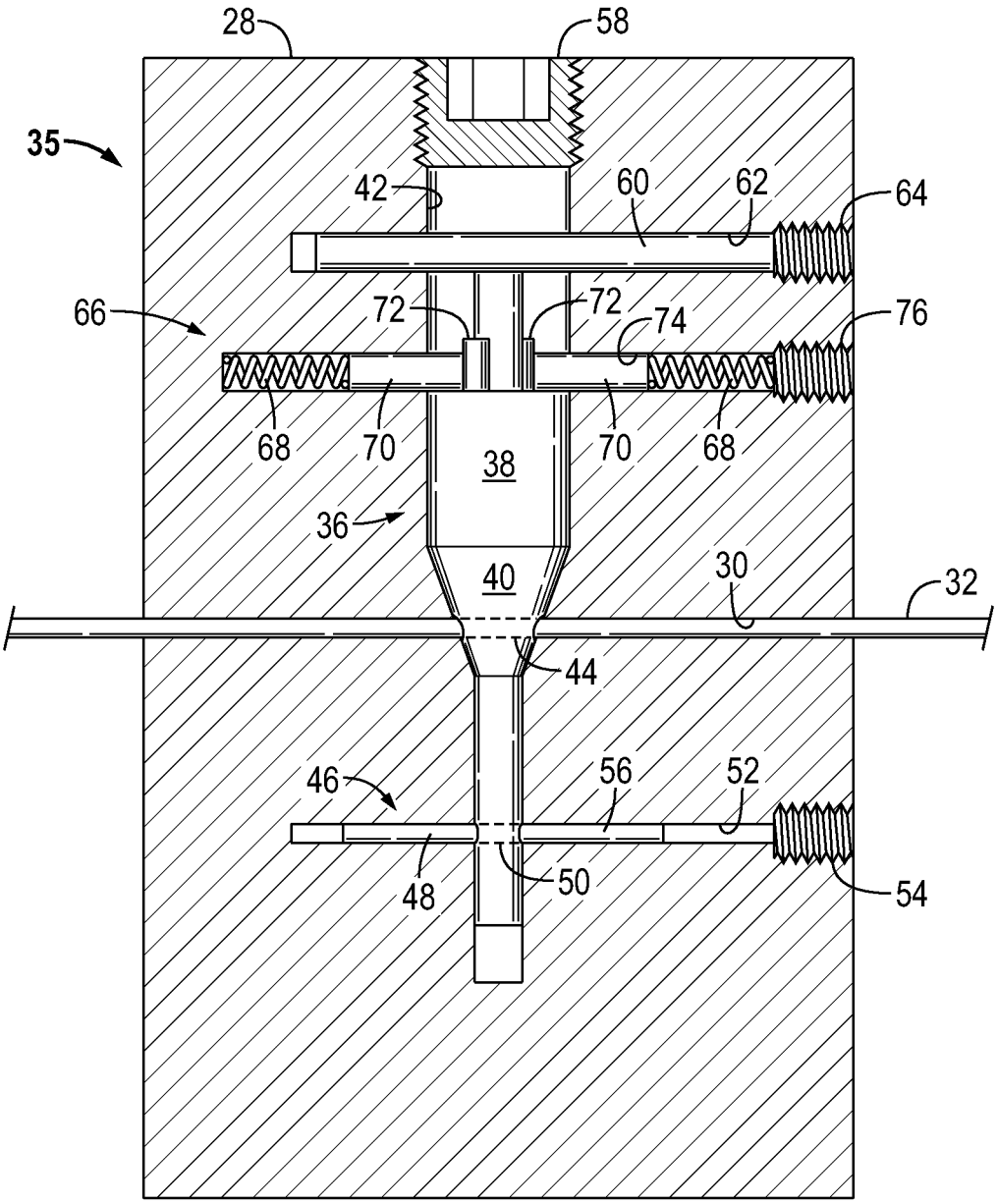
FIG. 2 is a cross-sectional view of an example of a structure having a closing device and a condition-sensitive device which may be used in a wellhead or other type of structure, according to an embodiment of the disclosure.

Referring generally to FIG. 2, an example of structure 28 is illustrated. The structure 28 may be used as a wellhead structure, as described above, or in other suitable applications. In this example, structure 28 comprises feed through 30 and works in cooperation with a protection system 35 which may be used to close off the feed through 30 upon the occurrence of a detrimental condition, e.g. an excessively high temperature or pressure condition. The protection system 35 comprises a closing device 36 positioned at the feed through 30. The closing device 36 may be constructed to rotate, translate, or both rotate and translate to close the feed through 30. In the example illustrated, the closing device 36 is constructed to enable movement which transitions the feed through 30 from an open position to a closed position while severing the communication line 32 (or other device) extending through feed through 30. This action results in creation of a barrier blocking and sealing the feed through path 30. As explained in greater detail below, the closing movement of closing device 36 is triggered by a specific condition, such as an elevated temperature or pressure condition.

In the specific example illustrated in FIG. 2, the closing device 36 comprises a rotatable member 38 having a conical section 40 which may be rotated to serve as a conical barrier. The rotatable member 38 is rotatably received in a corresponding space 42, e.g. a generally cylindrical space, formed in structure 28. In well applications, the structure 28 may be a wellhead outer flange adapter or other wellhead structure. As illustrated, the conical section 40 has a passage 44 which is generally aligned with feed through 30 when closing device 36 is in an open position. This allows the communication line 32 to pass through the feed through 30. The edges of passage 44 may be constructed to facilitate cutting of the munication line 32 as the closing device 36 is shifted to a closed position. In the example illustrated, closing device 36 is shifted to the closed position by rotating rotatable member 38 and conical section 40 until passage 44 is fully moved out of alignment with feed through 30, thus closing and sealing the feed through 30. In this example, the surface of conical section 40 forms a metal-to-metal seal with the corresponding wall surface defining space 42.

The protection system 35 further comprises a detrimental condition sensitive device 46, e.g. a temperature-sensitive device. In some applications, however, the device 46 may comprise a pressure-sensitive device or other type of condition-sensitive device constructed to detect a specific condition. In the illustrated example, device 46 comprises a temperature-sensitive device 46 mounted to the structure 28. In this type of application, the temperature-sensitive device 46 is automatically actuated upon exposure to a predetermined temperature, e.g. a high temperature caused by fire. The device 46 is operatively engaged with the closing device 36 so as to control actuation of the closing device 36 to a position closing and sealing the feed through 30.

The condition-sensitive device 46 may have a variety of configurations and components. In the example illustrated, device 46 comprises a shear member 48 which is readily sheared upon sufficient exposure to a predetermined temperature. The shear member 48 may be in the form of a pin or other suitable structure extending through a corresponding passage 50 in rotatable member 38 of closing device 36. The shear member/pin 48 may be inserted along a shear member passage 52 and through the aligned passage 50 in rotatable member 38 so as to secure closing device 36 in an open position in which feed through 30 remains open. The shear member passage 52 may be closed and sealed via a suitable plug 54 threadably or otherwise engaged with structure 28.

Depending on the application and the predetermined condition, the condition-sensitive device 46 may be formed with a variety of shear members 48 or other types of components which hold the closing device 36 in an open position until the predetermined condition is reached. If device 46 comprises a temperature-sensitive device, the shear member 48 may be formed from a degradable material 56. Material 56 degrades upon reaching the predetermined temperature to enable transition of the closing device 36 to a closed position, thus shearing communication line 32 and closing off feed through 30.

By way of example, degradable material 56 may comprise a material which melts at the predetermined temperature. A variety of metals, plastics, and composite materials may be used to provide the pin or other type of shear member 48 with a desired melting temperature. However, device 46 also may comprise a variety of other actuation techniques which release closing device 36 so that it may be actuated to the closed position. For example, bistable materials or materials with different coefficients of thermal expansion may be combined to temporarily hold the rotatable member 38 in an open position until a sufficiently high temperature is reached. Other materials and techniques also may be used to temporarily hold closing device 36 in the open position until occurrence of the predetermined temperature condition, pressure condition, or other condition.

In the example illustrated, protection system 35 comprises a variety of other components. For example, protection system 35 may comprise a plug 58 threadably or otherwise engaged with structure 28 to enclose the space 42 in which rotatable member 38 is rotatably received. By way of further example, production system 35 may comprise a blowout prevention plug 60 received in a corresponding slot 62 located in structure 28. The corresponding slot 62 and blow out prevention plug 60 are positioned directly above rotatable member 38 of closing device 36. The corresponding slot 62 may be sealed by a plug 64 threadably or otherwise secured to structure 28.

Figure 3:
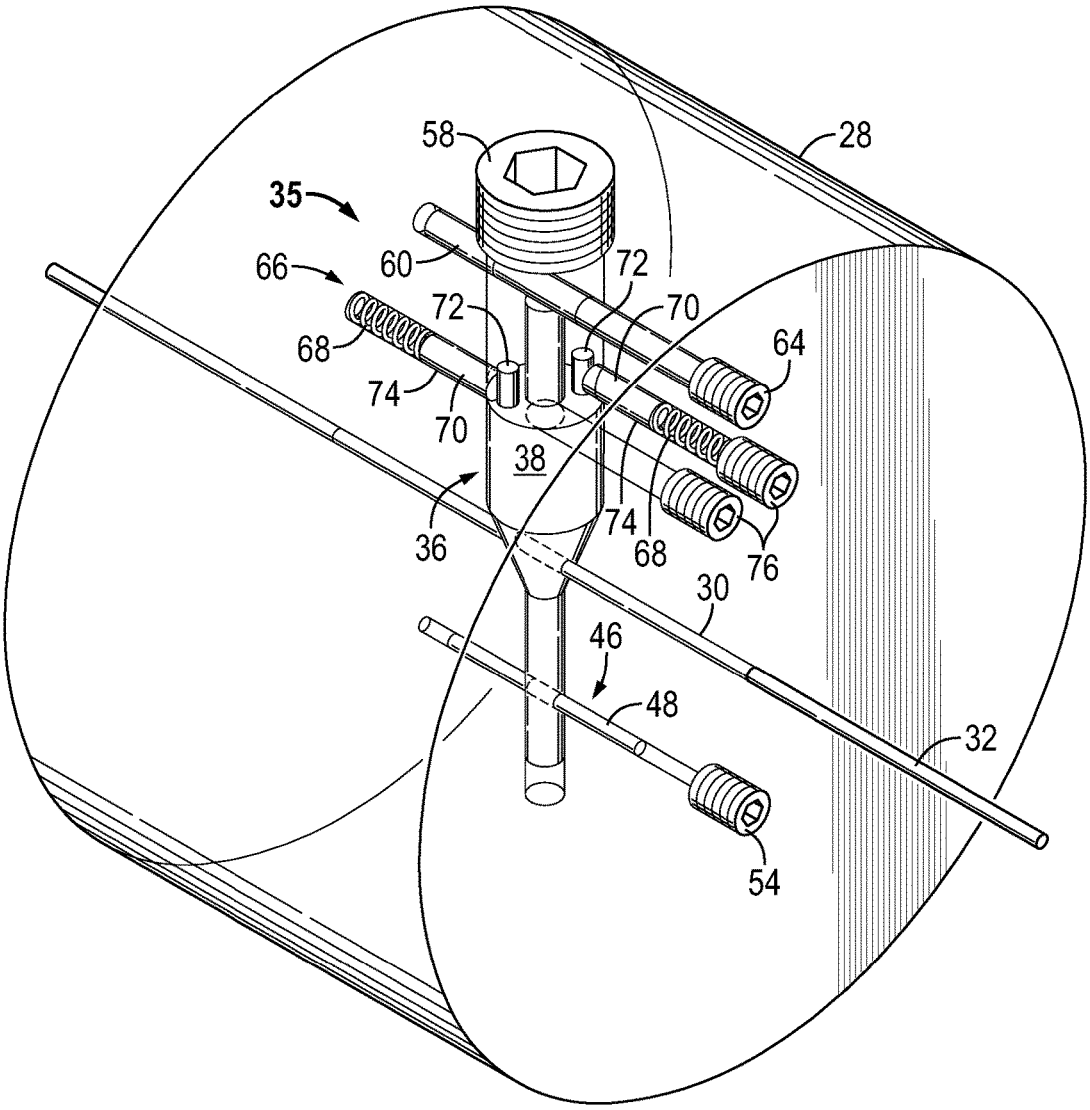
FIG. 3 is another view of the structure illustrated in FIG. 2, according to an embodiment of the disclosure.

Additionally, a biasing system 66 may be used to bias closing device 36 toward the closed position sealing off feed through 30. In an embodiment, biasing system 66 comprises a spring 68 which acts against rotatable member 38 in a manner which biases the rotatable member 38 to the closed position. With additional reference to FIG. 3, the biasing system 66 may comprise a plurality of springs 68, e.g. compression springs, which act against corresponding pushrods 70. The pushrods 70 are oriented to act against abutments 72 located on rotatable member 38 at offset positions relative to the axis about which rotatable member 38 is rotated.

This offset application of force provides sufficient bias to rotate the rotatable member 38 through communication line 32 and to a closed position sealing off feed through 30 once the rotatable member 38 is released by condition-sensitive device 46. Thus, once the predetermined condition, e.g. predetermined temperature, occurs, the condition-sensitive device 46 is automatically actuated to release closing device 36. The biasing system 66 is then able to actuate closing device 36 for movement to the closed position. In the specific example illustrated, the corresponding pairs of springs 68 and pushrods 70 are received in passageways 74 which may be enclosed by plugs 76 threadably or otherwise engaged with structure 28.

Figure 4:
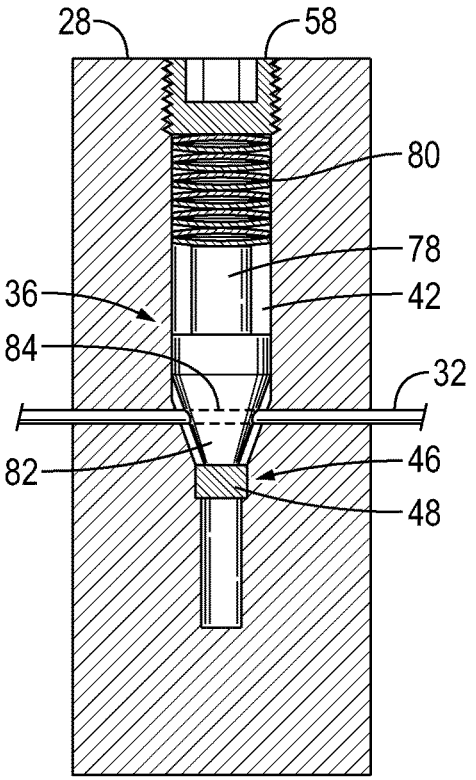
FIG. 4 is a cross-sectional view of another example of a structure having a closing device and a condition-sensitive device, according to an embodiment of the disclosure.

Referring generally to FIG. 4, another embodiment of protection system 35 is illustrated. In this embodiment, the protection system 35 employs closing device 36 in the form of a translatable device, e.g. a linearly translatable device, that may be translated between an open position and a closed position. In this example, the closing device 36 comprises a translatable member 78 which is biased toward a closed position by a spring member 80. By way of example, spring member 80 may comprise a compression spring, e.g a stack of belleville washers, which bias the translatable member 78 linearly toward a closed position which closes and seals feed through 30. As with the previous embodiment, the translatable member 78 may be received in corresponding space 42 which is enclosed by the plug 58.

In this latter example, the translatable member 78 may comprise a conical section 82 having a passageway 84 through which communication line 32 extends when the translatable member 78 of closing device 36 is in the open position. The closing device 36 is held in the open position against the bias of spring member 80 by condition-sensitive device 46. By way of example, the condition-sensitive device 46 may be a temperature-sensitive device 46 comprising shear member 48. Shear member 48 may be in the form of a degradable disk positioned to hold the translatable member 78 in the open position until the predetermined temperature is reached.

Depending on the application and the predetermined condition, the condition-sensitive device 46 may again be formed with a variety of shear members 48. The condition-sensitive device 46 also may be formed with other types of components which hold the closing device 36 in an open position until the predetermined condition is reached. If device 46 comprises a temperature-sensitive device, the shear member/disk 48 may be formed from degradable material 56. Material 56 degrades upon reaching the predetermined temperature to enable transition of the closing device 36 to a closed position, thus shearing communication line 32 and closing off feed through 30.

The degradable material 56 may again comprise a material which melts at the predetermined temperature. A variety of metals, plastics, and composite materials may be used to provide the disk or other type of shear member 48 with a desired melting temperature. However, device 46 also may comprise a variety of other actuation techniques which release closing device 36 so that it may be actuated to the closed position. For example, bistable materials or materials with different coefficients of thermal expansion may be combined to temporarily hold the translatable member 78 in an open position until a sufficiently high temperature is reached. Other materials and techniques also may be used to temporarily hold closing device 36 in the open position until occurrence of the predetermined temperature condition, pressure condition, or other condition.

Figure 5:
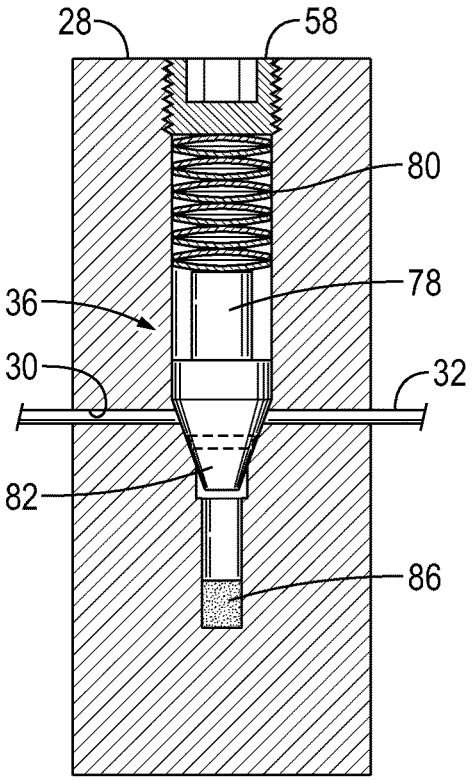
FIG. 5 is a cross-sectional view similar to that of FIG. 4 but showing the closing device and the condition-sensitive device in a different operational position, according to an embodiment of the disclosure.
Figure 6:
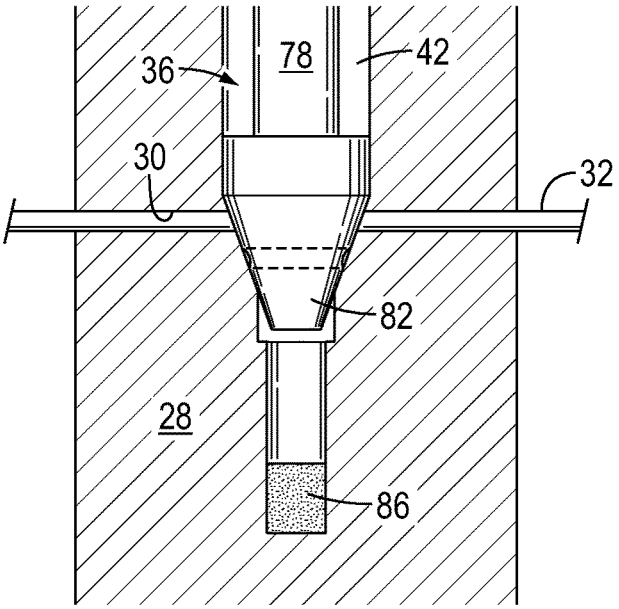
FIG. 6 is an expanded view of a portion of the structure illustrated in FIG. 5, according to an embodiment of the disclosure.

Once the predetermined condition is met, the condition-sensitive device 46 is actuated, e.g disk 48 melts, and closing device 36 is released for actuation to the closed position. As illustrated in FIGS. 5 and 6, the degradation of shear member/disk 48 enables spring member 80 to cause translatable member 78 to shear through the shear member/disk 48 until conical section 82 sealingly seats against the corresponding surface of interior space 42 in a closed position, as illustrated by FIG. 6. During translation to this closed position, the translatable member 78 is forced through the communication line 32, thus severing the communication line 32. In the example illustrated, the melted or degraded remains of shear member/disk 48 collect in a reservoir 86.

The system 20, e.g. well system, may be used in a variety of applications, including numerous well production applications, treatment applications, and non-well related tubing applications. Depending on the specifics of a given tubing string, well application, and environment, the construction of the overall system 20 and wellhead 22 may vary. Additionally, the system 20 may be designed for use in many types of wells, including vertical wells and deviated, e.g. horizontal, wells. The wells may be drilled in a variety of formations with single or multiple production zones and with many different types of downhole devices 34.

Depending on the application, the protection system 35 may be constructed in several configurations. For example, the closing device 36 and the condition-sensitive device 46 may have a variety of components and configurations. Additionally, the closing device 36 and condition-sensitive device 46 may be operatively engaged via a variety of techniques and components. If the condition-sensitive device 46 is a temperature-sensitive device, various materials able to melt or otherwise degrade at a desired temperature may be employed to at least temporarily hold the closing device in an open position. The closing device 36 also may be used in combination with individual or plural feed throughs arranged in various orientations. Similarly, many types of communication lines and combinations of communication lines (as well as other devices) may be routed through the feed through and subjected to severing if certain predetermined conditions are met.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a wellhead structure of a wellhead positioned above a well, the wellhead structure having a feed through;

a communication line extending through the feed through;

a condition-sensitive device mounted to the wellhead structure, the condition-sensitive device being automatically actuated upon exposure to a predetermined condition; and a closing device positioned at the feed through in operative engagement with the condition-sensitive device such that automatic actuation of the condition-sensitive device upon reaching the predetermined condition causes the closing device to close the feed through, wherein the closing device shears the communication line when the closing device closes the feed through.

2. The system as recited in claim 1, wherein the condition-sensitive device comprises a temperature-sensitive device mounted to the wellhead structure, the temperature-sensitive device being automatically actuated upon exposure to a predetermined temperature.

3. The system as recited in claim 1, wherein the communication line comprises an optical fiber.

4. The system as recited in claim 1, wherein the communication line comprises an electrical conductor.

5. The system as recited in claim 1, wherein the communication line comprises a hydraulic line.

6. The system as recited in claim 1, wherein the closing device is spring biased to close the feed through.

7. The system as recited in claim 2, wherein the temperature-sensitive device comprises a shear member.

8. The system as recited in claim 2, wherein the temperature-sensitive device melts upon reaching the predetermined temperature.

9. The system as recited in claim 1, wherein the closing device is rotated to close the feed through.

10. The system as recited in claim 1, wherein the closing device is translated to close the feed through.

11. A method, comprising:

providing a feed through in a wellhead structure of a wellhead positioned above a well;

routing a communication line through the feed through;

positioning a closing device in the wellhead structure at a location to enable closing of the feed through via the closing device; and using a temperature-sensitive device to hold the closing device in an open position until a predetermined temperature is reached, the predetermined temperature causing the temperature-sensitive device to initiate closing of the feed through via the closing device, wherein the closing device shears the communication line when the closing device closes the feed through.

12. The method as recited in claim 11, wherein positioning comprises positioning the closing device for rotation between an open position and a closed position.

13. The method as recited in claim 11, wherein positioning comprises positioning the closing device for translation between an open position and a closed position.

14. The method as recited in claim 11, wherein using the temperature-sensitive device comprises using a degradable pin to hold the closing device in an open position until the predetermined temperature is reached.

15. The method as recited in claim 11, wherein using the temperature-sensitive device comprises using a degradable disk to hold the closing device in an open position until the predetermined temperature is reached.

16. The method as recited in claim 11, further comprising shearing a communication line located in the feed through while closing the feed through.

17. A method, comprising:

providing a feed through in a wellhead structure of a wellhead positioned above a well;

routing a communication line through the feed through;

positioning a closing device in the wellhead structure at a location to enable closing of the feed through via the closing device; and using a condition-sensitive device to initiate actuation of the closing device to shear the communication line and to close the feed through once the condition-sensitive device is sufficiently exposed to a predetermined condition.

18. The method as recited in claim 17, wherein using comprises using a temperature-sensitive device having a material which degrades at a predetermined temperature.

19. The method as recited in claim 17, wherein the communication line comprises an optical fiber, an electrical conductor, or a hydraulic line.

20. The method as recited in claim 17, wherein the predetermined condition comprises a temperature condition.

* * * * *